United States Patent [19]

Kasaaian et al.

[11] 4,447,299

[45] May 8, 1984

[54] USE OF ALCOHOL FOR INCREASING THE CURRENT EFFICIENCY OF CHROMIUM PLATING

[75] Inventors: Arash S. Kasaaian; John Dash, both of Portland, Oreg.

[73] Assignee: State of Oregon Acting by and Through the State Board of Higher Education on behalf of Portland State University, Portland, Oreg.

[21] Appl. No.: 388,536

[22] Filed: Jun. 15, 1982

[51] Int. Cl.[3] ..... C25D 3/10; C25D 3/56

[52] U.S. Cl. ..... 204/43 R; 204/51

[58] Field of Search ..... 204/51, 43 R, 43 T, 204/105 R, 123

[56] References Cited

U.S. PATENT DOCUMENTS

| | | | |
|---|---|---|---|
| 3,909,372 | 9/1975 | Fujii | 204/51 |

FOREIGN PATENT DOCUMENTS

| | | | |
|---|---|---|---|
| 1269057 | 7/1961 | France | 204/51 |
| 51-76134 | 1/1976 | Japan | 204/43 T |
| 697225 | 9/1953 | United Kingdom | 204/51 |

*Primary Examiner*—G. L. Kaplan

*Attorney, Agent, or Firm*—Kolisch, Hartwell, Dickinson & Anderson

[57] ABSTRACT

Plating bath solution usable in the electrodeposition of chromium on a cathode which includes methyl and/or ethyl alcohol.

5 Claims, No Drawings

USE OF ALCOHOL FOR INCREASING THE CURRENT EFFICIENCY OF CHROMIUM PLATING

BACKGROUND AND SUMMARY

This invention relates to chromium plating, and more particularly to electrolytic chromium plating wherein chromium in a chromium plating bath solution is electrodeposited on the article plated.

Over the years, a number of different plating bath solutions have been proposed for chromium electrodeposition. A commonly used bath solution is a chromic acid bath, resulting from dissolving $CrO_3$ in water, and which further contains a sulfate catalyst, or a mixture of catalysts, such as sulfate and silicofluoride.

This invention is bottomed on the discovery that the addition of alcohol, i.e., methyl or ethyl alcohol, to a chromium plating bath solution containing dissolved chromium electrolyte significantly increases the current efficiency realized during the plating process. A further advantageous result is that chromium platings or coatings are produced tending to have a more uniform thickness, which offers the possibility of reducing the required thickness of a plating in a given application. It has also been observed that the inclusion of the alcohol affects the initial stages of chromium deposition, by speeding up the plating that occurs. By including alcohol in the bath solution, improved results are obtained from bath solutions containing the usual catalysts, and electrodeposition of chromium has been obtained utilizing bath solutions devoid of conventional catalyst. Particularly good current efficiencies have been observed in electrolytic platings performed using plating bath solutions containing a mixture of dissolved metallic electrolytes, such as dissolved chromium and iron electrolytes, to produce by electrodeposition alloy coatings.

A general object of this invention, therefore, is to provide an improved electrolytic process of chromium plating, and improved chromium plating bath solutions.

More particularly, an object of the invention is to provide improvements in an electrolytic process of chromium plating, and a chromium plating bath solution, which relies upon the incorporation in the bath solution of methyl or ethyl alcohol.

Various other objects, advantages and features of the present invention will become more fully apparent from a reading of the following description, which is to be taken in conjunction with accompanying examples included for the purpose of illustration.

DETAILED DESCRIPTION OF THE INVENTION

Describing a conventional electrolytic plating process, a chromium plating bath solution may be prepared from a chromium electrolyte, such as $CrO_3$, water, and a suitable catalyst such as sulfate ion obtained by introducing $H_2SO_4$ to the bath solution. A plating tank, vessel, or cell containing the bath solution is provided with one or more anodes, which may be of lead, and one or more cathodes, which constitute the articles to be plated, and a current is established between the anode and cathode structures. The plating process may typically be carried out at temperatures ranging from 20°–80° C. With the passage of time, chromium in the electrolyte solution becomes deposited on the cathode structure. The present invention may be carried out using conventional equipment and conventional temperatures.

Chromium plating in the past has been carried out on various types of cathode substrates. Such include nickel substrates, low-carbon steel substrates, iron substrates, copper substrates, etc. As far as has been observed, the present invention is applicable to all of such commonly employed substrates.

As indicated earlier, the present invention is based on the discovery that the inclusion of methyl or ethyl alcohol in chromium based electrolytic plating baths has been found to produce significant improvement in the current efficiency of the chromium plating process. Other results noted have been the production, by reason of the inclusion of such alcohol, of more even coatings, and an acceleration in chromium deposition at the initial stages of the plating process.

The amount of alcohol employed in a typical chromium based plating bath solution is not substantial. In general terms, beneficial results might be expected with alcohol inclusions ranging from 0.25 to 80 mls. of alcohol/l. of bath solution.

Current efficiency, as the term is used herein, is calculated by determining the mass of the material deposited on the cathodic substrate during the plating process (which may be calculated by determining the weight gain in the plated article) and dividing this quantity by the theoretical mass that would be electrodeposited under 100% efficient conditions, which assumes that all the electrons transferred by the current employed in the electroplating are effective to reduce metal ions in the electrolyte of the bath solution to metal atoms deposited on the cathode structure.

Set forth below are several examples which further illustrate the invention. In these examples, and when describing the composition of different bath solutions, quantities indicated are for each liter (l.) of bath solution.

EXAMPLE I

Electroplating was performed in apparatus including a vessel containing 25 mls. of plating bath solution. The article plated, or cathode specimen, was a rectangular piece of sheet material having a combined surface area on opposite sides thereof of 2 cms.$^2$. One hollow cylindrical lead anode placed in a position surrounding the cathode specimen had a surface area submersed in the bath solution of 24 cms.$^2$. Using apparatus as described, plating was performed on a stainless steel substrate, i.e., cathode specimens of stainless steel composition, for a period of 1 hour. The temperature of the bath solution was maintained at 40° C. A current density with direct current was maintained at 0.25 A (amperes)/cms.$^2$. Plating, utilizing the conditions just described, was performed employing various bath solutions containing, in addition to distilled water, 250 grs. $CrO_3$, 2 mls. $H_2SO_4$ (conc.), and varying amounts of methyl alcohol. All chemicals were reagent grade. In most instances, several platings were performed with each composition of bath solution. The following table summarizes results obtained from the various platings that were performed.

TABLE I

| Methyl Alcohol Content of Bath Solution (mls.) | Average Current Efficiency (%) | Increase in Current Efficiency due to Methyl Alcohol |
|---|---|---|
| 0 | 22.0 | — |

TABLE I-continued

| Methyl Alcohol Content of Bath Solution (mls.) | Average Current Efficiency (%) | Increase in Current Efficiency due to Methyl Alcohol |
|---|---|---|
| 0.84 | 24.4 | +10.9 |
| 0.89 | 25.7 | +16.8 |
| 0.95 | 26.0 | +18.2 |
| 1.00 | 25.4 | +15.5 |
| 1.05 | 24.9 | +13.2 |

Scratch marks were made with an engraving tool on faces of various cathode specimens employed in the above platings, prior to the plating process. It was observed that in platings produced utilizing bath solutions containing methyl alcohol, such scratch marks were not discernable, whereas with platings produced without the inclusion of methyl alcohol, they were clearly discernable.

EXAMPLE II

Platings were performed on low carbon (0.18% carbon) steel substrates. In plating 10 cathode specimens, an aqueous bath solution containing 250 grs. $CrO_3$ and 2 mls. $H_2SO_4$, and devoid of methyl alcohol, was utilized. The same composition of bath solution, save for the inclusion in the bath solution of 0.95 ml. methyl alcohol, was utilized in plating 10 other cathode specimens. Plating time for the platings performed with a bath solution without methyl alcohol was 3.5 seconds, and for the platings performed with a bath solution including methyl alcohol was 3.2 seconds. The plating apparatus and operating conditions employed otherwise were the same as those set forth in Example I.

The 10 cathode specimens that were plated using a bath solution containing no methyl alcohol had no discernable cumulative weight gain, whereas the 10 specimens plated with a bath solution containing methyl alcohol exhibited a commulative weight gain of 0.5 mgs.

EXAMPLE III

Platings were performed utilizing bath solutions devoid of a conventional catalyst, such as sulfate or silicofluoride, but including various amounts of methyl alcohol. Table II set forth below summarizes the results obtained from such platings utilizing a bath solution containing, in addition to distilled water, 250 grs. of $CrO_3$, and further including methyl alcohol in the amounts indicated in the table. The cathode specimens were nickel coated. Otherwise, the apparatus and operating conditions employed were the same as set forth in Example I.

TABLE II

| Methyl Alcohol Content of Bath Solution (mls.) | Current Efficiency (%) | Appearance of Plating |
|---|---|---|
| 0 | 0 | none |
| 0.96 | 0.23 | essentially black |
| 3 | 0.40 | essentially black |
| 10 | 0.46 | metallic |
| 25 | 10.2 | metallic |

TABLE II-continued

| Methyl Alcohol Content of Bath Solution (mls.) | Current Efficiency (%) | Appearance of Plating |
|---|---|---|
| 35 | 10.3 | metallic |
| 50 | 6.2 | metallic |

EXAMPLE IV

In another series of platings, a $CrO_3$ bath solution containing sulfate catalyst was employed in plating a series of cathode specimens, the bath solution including an ethyl alcohol additive. Specifically, the bath solution contained $CrO_3$ and $H_2SO_4$ in the amounts indicated in Example I, and further, 0.96 mls. ethyl alcohol. Plating was done over a period of 5 min. on nickel coated cathode specimens. The apparatus and plating conditions, except as set forth above, were the same as in Example I.

An average of 26 platings performed in the manner described exhibited a current efficiency of 29.7%. This compares with a plating efficiency of 20.4% obtained when utilizing a bath solution devoid of ethyl alcohol but otherwise having the same composition.

Platings were also performed utilizing bath solutions including chromium electrolytes other than $CrO_3$, and electrolytes of other metals than chromium. The following examples illustrate results obtained.

EXAMPLE V

Platings were performed on nickel plated substrates, i.e., nickel plated cathode specimens, utilizing as a bath solution an aqueous solution containing 250 grs. $CrO_3$, 128 grs. $CrCl_3.6H_2O$, and 1 ml. $H_2SO_4$. A plating was performed without the inclusion of methyl alcohol in the bath solution, and a series of platings were performed with the addition of 15 mls. of methyl alcohol to the bath solution. Plating time was 5 min. In other respects, the apparatus and conditions employed were the same as in Example I.

Current efficiency calculated in connection with the plating performed using a bath solution without methyl alcohol was 0. Average current efficiency noted in connection with 11 platings performed using a bath solution containing methyl alcohol was 38%. In the latter case, platings obtained on the cathode specimens were bright over the faces of the specimens.

EXAMPLE VI

In another group of platings, both solutions were prepared from electrolytes containing both trivalent and hexavalent chromium, and the salt of another metal, namely, divalent iron ($FeCl_2.4H_2O$). The temperature of the bath solution was 42° C. Plating time was 5 min. The cathode specimens were nickel coated. Three different series of platings were performed, utilizing aqueous bath solutions with compositions as indicated in Table III set forth below. Other than as above indicated, operating conditions and equipment were the same as in Example I.

TABLE III

| | Methyl Alcohol of Bath Solution (mls.) | $CrO_3$ content (grs.) | $FeCl_2.4H_2O$ content (grs.) | $CrCl_3.6H_2O$ content (grs.) | Average Current Efficiency (%) |
|---|---|---|---|---|---|
| Series a | 20 | 250 | 62.6 | 72.2 | 52 |
| Series b | 20 | 250 | 143 | 0 | 70 |

TABLE III-continued

| | Methyl Alcohol of Bath Solution (mls.) | $CrO_3$ content (grs.) | $FeCl_2.4H_2O$ content (grs.) | $CrCl_3.6H_2O$ content (grs.) | Average Current Efficiency (%) |
|---|---|---|---|---|---|
| Series c | 20 | 250 | 71.2 | 0 | 42 |

All coating deposits were shiny, except series b had dull edges. Coatings produced were iron and chromium alloy coatings.

EXAMPLE VII

Another series of platings were performed on nickel plated substrates, i.e., cathode specimens. The bath solution, in addition to water, contained the following: 150 grs. $CrO_3$, 42.7 grs. $FeCl_2.4H_2O$, 38.4 grs. $CrCl_3.6H_2O$, 0.6 mls./$H_2SO_4$, 12 mls. methyl alcohol. Plating time was 5 min. Other than as specified, the apparatus and operating conditions were as in Example I.

The platings obtained were uniformly shiny. Average current efficiency was 40%.

EXAMPLE VIII

A bath solution was prepared containing, in addition to water, the following: 250 grs. $CrO_3$, 72 grs. $CrCl_3.6H_2O$, 60 grs. $FeCl_2.4H_2O$, 1 ml. $H_2SO_4$, and 20 mls. methyl alcohol. Such bath solution was used in the plating of nickel coated cathode specimens, utilizing different plating times, as set forth in Table IV below. Except as otherwise indicated, apparatus and operating conditions were as set forth in Example I. In Table IV, the results obtained from the platings are indicated.

TABLE IV

| Plating Time (min.) | Current Efficiency (%) | Appearance of Deposits |
|---|---|---|
| 3 | 42 | uniformly shiny |
| 3 | 41 | uniformly shiny |
| 3 | 43 | uniformly shiny |
| 10 | 48 | shiny except on edge |
| 45 | 45 | shiny except on edge |

EXAMPLE IX

A base solution was prepared by boiling a solution containing 250 grs. $CrO_3$ and an excess of $Cr_2(SO_4)_3$ for 20 min., to insure saturation with the $Cr_2(SO_4)_3$. Platings were performed with this base solution, modified to include, various amounts of methyl alcohol. Time of plating was 5 min., and different current densities were used. Apparatus and operating conditions otherwise were as indicated in Example I. Table V indicates the amount of methyl alcohol used and current density employed, in the different platings, and current efficiencies obtained.

TABLE V

| Methyl Alcohol content of Bath Solution (mls.) | Current Density (A/cm.$^2$) | Current Efficiency (%) | Appearance of Deposits |
|---|---|---|---|
| 20 | 0.25 | 38 | 50% shiny, 50% dull |
| 20 | 0.15 | 11 | uniformly shiny |
| 20 | 0.20 | 25 | 80% shiny, 20% dull |
| 20 | 0.18 | 19 | 90% shiny, 10% dull |
| 30 | 0.25 | 46 | 50% shiny, 50% dull |
| 30 | 0.15 | 25 | 95% shiny, 5% dull |
| 30 | 0.20 | 38 | 80% shiny, 20% dull |

TABLE V-continued

| Methyl Alcohol content of Bath Solution (mls.) | Current Density (A/cm.$^2$) | Current Efficiency (%) | Appearance of Deposits |
|---|---|---|---|
| 30 | 0.18 | 31 | 80% shiny, 20% dull |

In other platings using a current density of 1.00 A/cms.$^2$, current efficiencies of 50% and 54% were obtained with methyl alcohol additions of 20 mls. and 30 mls., respectively.

EXAMPLE X

A plating tank holding approximately 57 ls. of bath solution was employed in the plating of a cathode specimen in the form of a cylinder 6.3 cms. long and having a diameter of 3.8 cms. As anode structure, the plating apparatus had 4 anodes distributed about the cathode specimen, each 2.54 cms. in diameter and approximately 20.5 cms. in length. The cathode specimen was made of low carbon steel.

Plating was performed utilizing a bath solution containing 250 grs. of $CrO_3$ and 1.4 mls. $H_2SO_4$. Plating was done at a temperature of 64° C., and with a current density of 1.25 A/cms.$^2$, over a period of 3 hours. A plating was produced on the cathode specimen having a thickness of 0.0190 cms. Chemicals were commercial grade.

In another plating, a bath solution was employed containing, in addition to the above, 0.6 ml. $H_2SO_4$, and 0.8 ml. methyl alcohol. The apparatus and plating conditions in this second plating otherwise were the same as in the first plating. The thickness of the plating produced on the cathode specimen was 0.0213 cms.

Why the inclusion of alcohol to an aqueous plating solution produces the unexpected beneficial results above-described is not entirely understood. The effect of an alcohol addition to a plating bath in the first instance was, in fact, discovered by accident, through examining results of various tests which could be explained by the fact that methyl alcohol inadvertently had been introduced into the plating solution. While not fully understanding the mechanics of what occurs in the electroplating bath solution, it is felt that the results may at least partially be explained by considering the following equation representative of a reaction that is believed to occur in a chromic acid bath solution which includes methanol:

$$4CrO_3+3CH_3OH+12H^+=3HCOOH+4Cr^{+++}+9H_2O$$

With this reaction occurring, formic acid is produced, believed to have a catalytic effect in the electrodeposition of chromium. Additionally, it will be noted that hexavalent chromium by the reaction is converted to trivalent chromium, which is part of the reduction reaction which occurs with the electrodeposition of chromium atoms on the cathode.

While various specific examples have been set forth, this is for purposes of illustration and not limitation, as obviously other electroplating bath solutions are possible following the herein disclosed invention. Accordingly, it is desired to cover all modifications and variations of the inventions as would be apparent to one skilled in the art.

It is claimed and desired to secure by Letters Patent:

1. In the electrolytic process of chromium plating an article by the electrodeposition of chromium from an aqueous bath solution containing dissolved $CrO_3$ electrolyte, the improvement comprising, with a bath solution containing metallic cations limited to the group consisting of chromium and iron, enhancing current efficiency by including in said bath solution methyl alcohol, in an amount within the range of from 0.25 mls to 80 mls of alcohol/l. of bath solution.

2. The process of claim 1, wherein the bath solution is a sulfate-catalyzed bath solution.

3. The process of claim 2, wherein the bath solution further includes chlorine ions introduced as salts of iron and/or chromium.

4. The process of claim 1, wherein the bath solution contains dissolved trivalent and hexavalent chromium electrolyte.

5. The process of claim 1, wherein the bath solution contains dissolved chromium and iron electrolyte with the production of an iron and chromium alloy plating.

* * * * *